US009102442B2

(12) United States Patent
Glass et al.

(10) Patent No.: US 9,102,442 B2
(45) Date of Patent: Aug. 11, 2015

(54) CONTAINER WITH PRESENTATION ELEMENT

(71) Applicant: Gift Card Impressions, LLC, Kansas City, MO (US)

(72) Inventors: Brett R. Glass, Kansas City, MO (US); Nicole E. Glass, Kansas City, MO (US)

(73) Assignee: Gift Card Impressions, LLC, Kansas City, MO (US)

( * ) Notice: Subject to any disclaimer, the term of this patent is extended or adjusted under 35 U.S.C. 154(b) by 0 days.

(21) Appl. No.: 14/151,743

(22) Filed: Jan. 9, 2014

(65) Prior Publication Data

US 2014/0190850 A1 Jul. 10, 2014

Related U.S. Application Data

(60) Provisional application No. 61/750,477, filed on Jan. 9, 2013.

(51) Int. Cl.

| | |
|---|---|
| ***B42D 15/04*** | (2006.01) |
| ***B65D 33/00*** | (2006.01) |
| ***G09F 1/06*** | (2006.01) |

(52) U.S. Cl.
CPC ..... *B65D 33/004* (2013.01); *B42D 15/045* (2013.01); *G09F 1/06* (2013.01)

(58) Field of Classification Search
CPC ..... B42D 15/045; G09F 1/06
USPC ..... 40/124.06, 124.08, 124.11, 124.19; 383/40; 206/457, 232; 428/542.2
See application file for complete search history.

(56) References Cited

U.S. PATENT DOCUMENTS

| | | | | |
|---|---|---|---|---|
| 5,401,102 | A * | 3/1995 | Faltynek et al. | 383/104 |
| 5,836,095 | A * | 11/1998 | Crowell | 40/299.01 |
| 6,053,399 | A * | 4/2000 | Wurdeman | 229/68.1 |
| 6,073,372 | A * | 6/2000 | Davis | 40/124.16 |
| 6,345,912 | B1 * | 2/2002 | Ho | 383/20 |
| 2004/0069661 | A1 * | 4/2004 | Telleen | 206/232 |
| 2004/0195134 | A1 * | 10/2004 | Li | 206/457 |
| 2006/0064906 | A1 * | 3/2006 | Flemons | 40/124.06 |
| 2006/0101679 | A1 * | 5/2006 | Glenn | 40/124.09 |
| 2006/0151340 | A1 * | 7/2006 | Meister | 206/232 |
| 2006/0196787 | A1 * | 9/2006 | Lewis | 206/232 |
| 2007/0201772 | A1 * | 8/2007 | Schindele | 383/40 |

* cited by examiner

*Primary Examiner* — Gary Hoge
(74) *Attorney, Agent, or Firm* — Polsinelli PC

(57) ABSTRACT

A container for receiving a gift, having a reclosable presentation engaged to a surface thereof. The container includes pleated sides to accommodate different size gifts and may further include a graphics or other indicia to indicate a holiday or other gift giving occasion.

9 Claims, 7 Drawing Sheets

CONTAINER WITH PRESENTATION ELEMENT

RELATED APPLICATIONS

This application claims priority to U.S. Provisional Patent Application No. 61/750,477 filed Jan. 9, 2013, and entitled "Container with Presentation Element," the entire contents of which are incorporated herein by reference.

FIELD

The present disclosure relates generally to gift holding containers including gift boxes and gift bags. In particular, this disclosure relates to a container for holding gift items that includes a reclosable presentation element engaged thereto.

BACKGROUND

Many existing gift containers or packaging include tags and presenting indicia such as words or symbols for indicating the identity of the gift giver and/or of the gift recipient. These include paper bags having relatively planar front, back, and bottom panels and pleated sides. Existing containers, however, often provide minimal interaction when opened by the recipient and thus do not enhance the gift giving experience.

SUMMARY

The present disclosure relates generally to gift holders and more particularly to a container for holding gift items that provides a reclosable presentation element for revealing and presenting a gift or information associated with a gift.

One embodiment of a container for holding a gift includes a main body having a plurality of sides and a closed bottom portion. The plurality of sides define a chamber having an open end opposite the closed bottom portion. The container also includes a reclosable presentation element engaged to a side of the main body. The presentation element having an open configuration and a closed configuration, and further includes a central panel and one or more articulating panels hingedly engaged to one or more margins of the central panel.

Another embodiment of the container with an articulating includes a main body that further includes a plurality of sides and a closed bottom portion. The plurality of sides define a chamber having an open end opposite the closed bottom portion.

The container also includes a reclosable presentation element engaged to a side of the main body. The presentation element defines a receptacle having an open configuration and a closed configuration.

The presentation element includes central panel having plurality of margins. The presentation element also includes a plurality of articulating major panels corresponding to the plurality of margins, where each of the plurality of articulating major panels is hingedly engaged to the corresponding central panel margin. The presentation element further includes a plurality of articulating minor panels disposed between the plurality of articulating major panels, where a first margin of each of the plurality of articulating minor panels is hingedly engaged to one articulating major panel and a second margin of each of the plurality of articulating minor panels is hingedly engaged to another articulating major panel.

Each of the plurality of articulating major panels rotates about the corresponding central panel margin inwardly and towards the central panel to assume the closed configuration and each of the plurality of articulating major panels rotates about the corresponding central panel margin outwardly and away from the central panel to assume the open configuration.

One embodiment of a gift holding device includes a container with a folding and unfolding presentation element attached to a panel thereof. The main body includes a longitudinal axis therethrough from a bottom end to an upper end. The sides and bottom end of the main body are typically substantially closed and the upper end is typically substantially open. The sides are connected to one another around the outer margins of the main body and are transversely spaced apart from the longitudinal axis. The sides are typically, generally parallel to the longitudinal axis when the main body is completely open. The sides terminate at their lower margins at the closed bottom end and terminate at their upper margins at the open upper end. Two opposing sides are typically creased or pleated to allow these sides to fold inward to collapse the main body to a folded position.

A presentation element is attached to a side of the container, typically a non-pleated or non-creased side and typically a front side. Although the description herein references a presentation element attached to and extending from the front side, it should be appreciated the front and back are merely relative to one another and in certain embodiments the presentation element could be described as extending from the back side. The presentation element is constructed of and includes a plurality of articulated panels, including major panels and minor panels. The articulated panels are attached to a center or central panel. The center panel includes a first or left margin, a second or right margin, a third or top margin and fourth or bottom margin. A first major panel extends from the first margin, a second major panel extends from the second margin, a third major panel extends from the third margin, and a fourth major panel extends from the fourth margin. A series of minor articulating panels are interposed between the major panels. These articulating panels are hinged or pivotable engaged to the adjacent major panels.

Other advantages of the invention will become apparent from the following description taken in connection with the accompanying drawings, wherein is set forth by way of illustration and example an embodiment of the present invention.

DETAILED DESCRIPTION

Figure 1A:
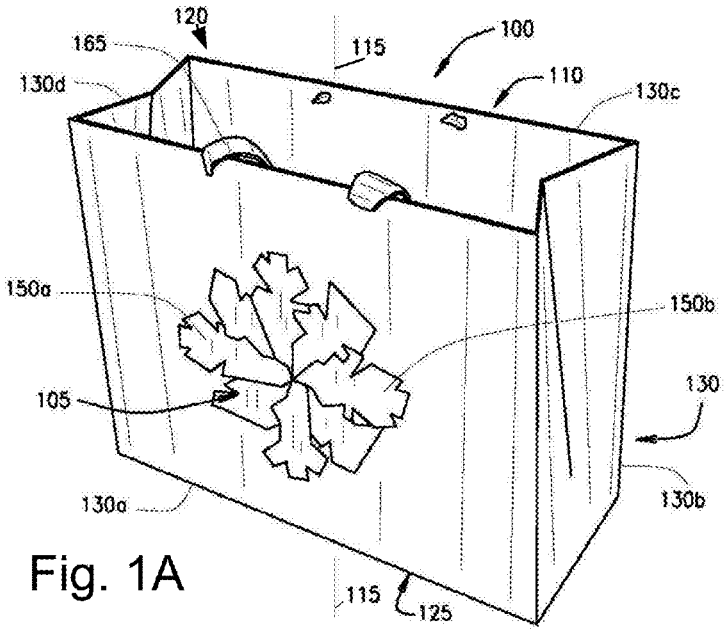
FIG. 1A is a front, right perspective view of a container including a presentation element on a front side thereof according to one embodiment.
Figure 1B:
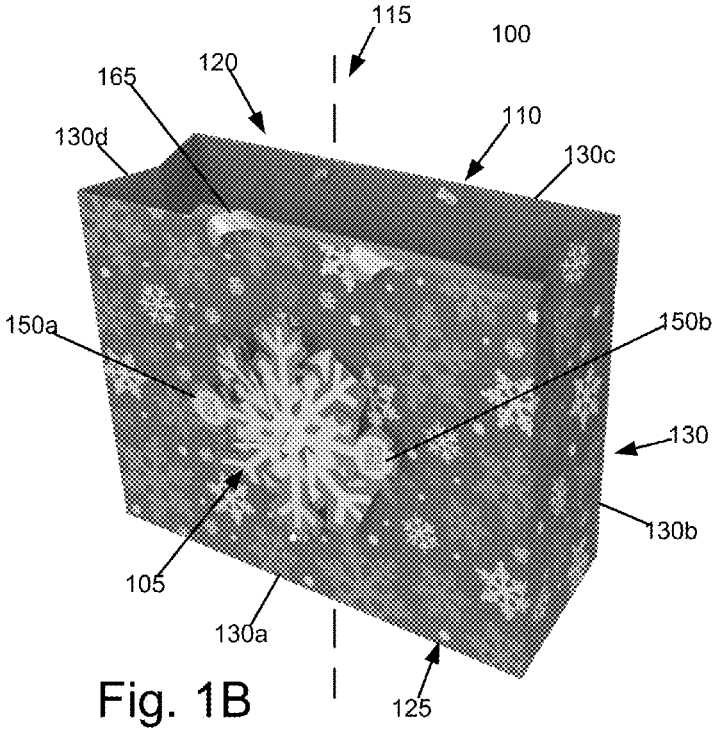
FIG. 1B is a front, right perspective photograph of a container including a presentation element on a front side thereof according to one embodiment.
Figure 2A:
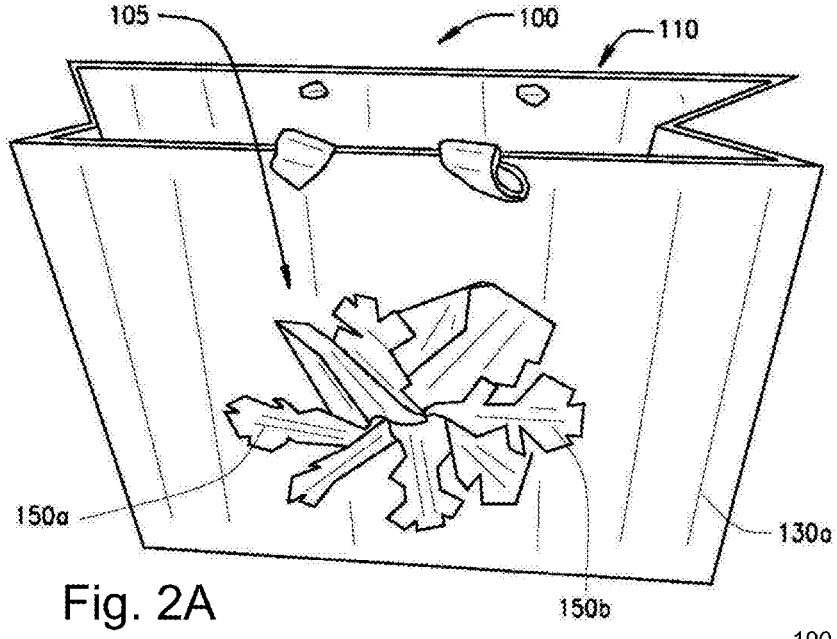
FIG. 2A is a front, top perspective view of the container of FIGS. 1A-B according to one embodiment.
Figure 2B:
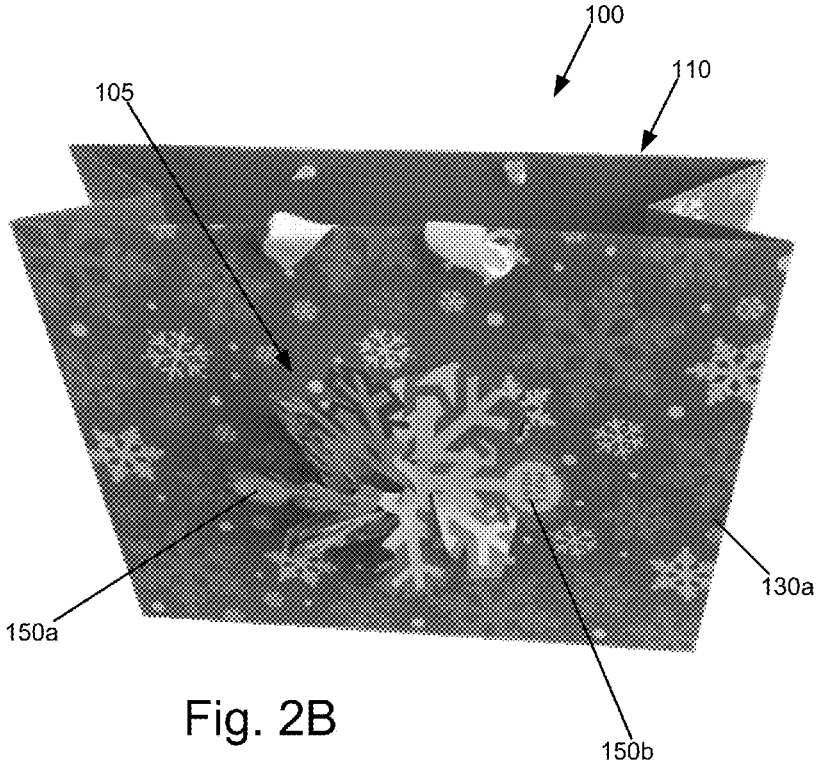
FIG. 2B is a front, top perspective photograph of the container of FIGS. 1A-B according to one embodiment.

The present disclosure relates generally to gift holders and gift bags. In particular, this disclosure relates to a container for holding gift items that includes a reclosable presentation element engaged thereto. In one aspect, the presentation element is a foldable structure that may be opened and closed by the manipulation and folding of various panels and tabs. In various aspects, the presentation element resembles a work of origami. The presentation element and the container may be made in a variety of sizes and may be dimensioned to hold gifts and gift cards of various sizes. The container may be a bag, a box, or other container. In various aspects, the container and the attached presentation element may be constructed of various types of paper, cardboard, card stock, plastics, or other resilient materials and may bear various graphics and designs while maintaining the general structure and functionality described herein.

As shown in the figures, a container 100 having a number of features and components is engaged to a reclosable presentation element 105. In one embodiment, the presentation element 105 is affixed or otherwise engaged to a front side of the container 100, as shown in FIGS. 1A-2B. In various embodiments, the container 100 includes a main body 110 having a longitudinal axis 115 therethrough from a top end 120 to a bottom end 125 and substantially closed transverse sides 130. The sides 130 and bottom end 125 of the main body 110 are typically substantially closed and the top end 120 is typically substantially open. The sides 130 are connected to one another around the outer margins of the main body 110 and are transversely spaced apart from the longitudinal axis 115. The sides 130 are typically, generally parallel to the longitudinal axis 115 when the main body 110 is completely open.

The sides 130 of the main body 110 include a first side 130*a*, a second side 130*b* adjoining the first side 130*a* and adjoining a third side 130*c*, the third side 130*c* adjoins the second side 130*b* and adjoins a fourth side 130*d*, the fourth side 130*d* adjoins the third side 130*c* and the first side 130*a*. The sides (referred to collectively by reference numeral 130) terminate at the substantially closed bottom end 125 and terminate at the open top end 120. Two opposing sides, e.g. side 130*b* and 130*d*, are typically creased or pleated to allow these sides to fold inward to collapse the main body 110 to a folded position.

Figure 8:
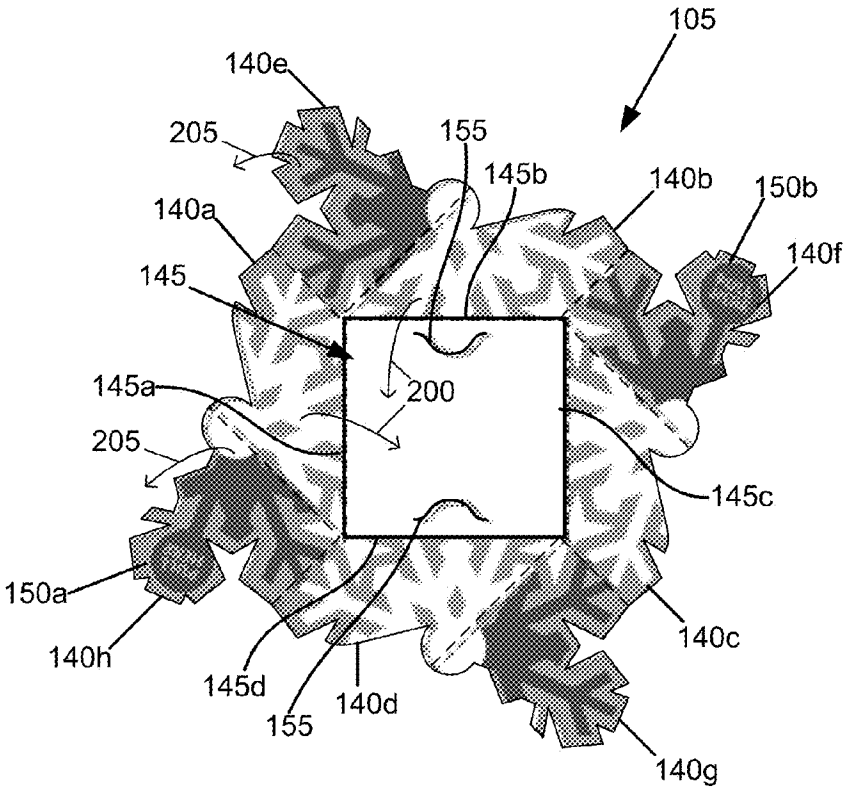
FIG. 8 is a plan view of the front surfaces of the presentation element according to one embodiment.
Figure 7:
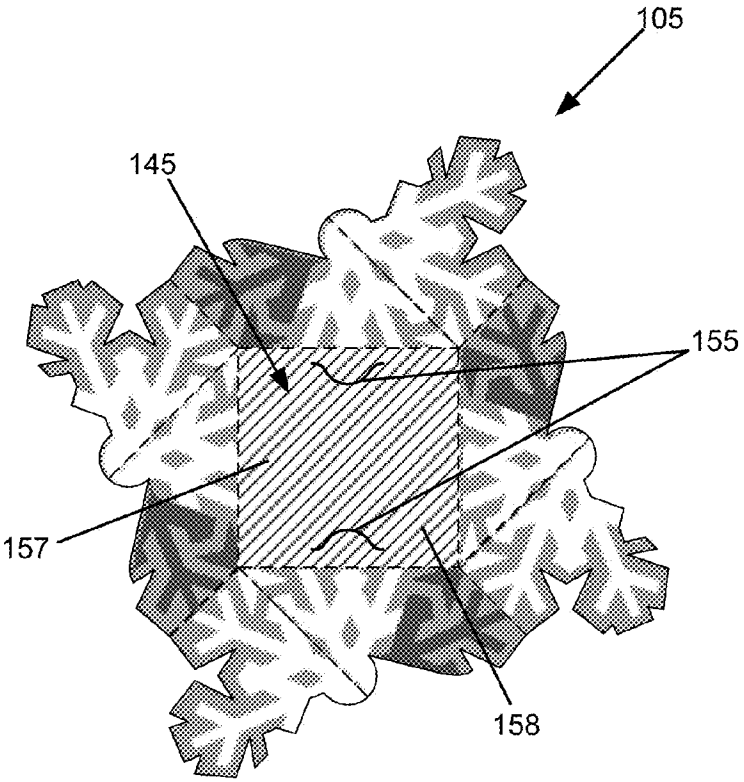
FIG. 7 is a plan view of the rear surfaces of the presentation element according to one embodiment.

The reclosable presentation element 105 is attached to a side of the container 100, typically a non-pleated or non-creased side and typically a front side, such as the first side 130*a*, as shown in FIGS. 1A-4B. A plan view of one embodiment of the rear surfaces of the presentation element 105 is shown if FIG. 7, while FIG. 8 depicts a plan view of the front surfaces of the presentation element 105. In one embodiment, the presentation element 105 is constructed of and includes a plurality of articulated panels 140*a-h* (the articulated panels are referred to collectively using reference numeral 140). The articulated panels 140 are attached to a center or central panel 145 to define a receptacle. The center panel 145 includes a first or left margin 145*a*, a second or top margin 145*b*, a third or right margin 145*c* and fourth or bottom margin 145*d*. The articulated panels 140 include four major panels 140*a-d*. A first major panel 140*a* extends from the first margin 145*a*, a second major panel 140*b* extends from the second margin 145*b*, a third major panel 140*c* extends from the third margin 145*c*, and a fourth major panel 140*d* extends from the fourth margin 145*d*.

A series of articulating minor panels 140*e-h* are disposed between the major panels 140*a-d*. In particular, a first minor panel 140*e* is interposed between the first major panel 140*a* and the second major panel 140*b*. The first minor panel 140*e* is in hinged or pivotable engagement with the first major panel 140*a* along one side thereof and is in hinged engagement with the second major panel 140*b* along another side thereof. Similarly, a second minor panel 140*f* is interposed between the second major panel 140*b* and the third major panel 140*c*. The second minor panel 140*f* is in hinged or pivotable engagement with the second major panel 140*b* along one side thereof and is in hinged engagement with the third major panel 140*c* along another side thereof.

The third minor panel 140*g* is interposed between the third major panel 140*c* and the fourth major panel 140*d*. The third minor panel 140*g* is in hinged or pivotable engagement with the third major panel 140*c* along one side thereof and is in hinged engagement with the fourth major panel 140*d* along another side thereof. The fourth minor panel 140*h* is interposed between the fourth major panel 140*d* and the first major panel 140*a*. The fourth minor panel 140*h* is in hinged or pivotable engagement with the fourth major panel 140*d* along one side thereof and is in hinged engagement with the first major panel 140*a* along another side thereof.

When the articulating panels 140 (and therefore the presentation element 105) are closed or folded into a closed configuration, the major panels 140*a*, 140*b*, 140*c*, and 140*d* fold inwardly, as generally indicated by 200 in FIG. 8, and face the central panel 145. The minor panels 140*e*, 140*f*, 140*g*, and 140*h* also fold inwardly relative to the center panel 145, however, the minor panels are also folded in a retrograde direction, as generally indicated by 205, so that the front surfaces of the minor panels face outward and away from the central panel.

In the folded or closed configuration, the first major panel 140*a* partially overlies the first minor panel 140*e*, the first minor panel 140*e* partially overlies the second major panel 140*b*, and the second major panel 140*b* partially overlies the second minor panel 140*f*. Similarly, the second minor panel 140*f* partially overlies the third major panel 140*c*, the third major panel 140*c* partially overlies the third minor panel 140*g*, the third minor panel 140*g* partially overlies the fourth major panel 140*d*, the fourth major panel 140*d* partially overlies the fourth minor panel 140*h*, and the fourth minor panel 140*h* partially overlies the first major panel 140*a*. It should be appreciated that this pattern of sequentially, partially, overlying, articulated panels 140 could be modified, e.g. reversed, in alternative embodiments.

As shown in one embodiment of the presentation element 105, the minor panels 140*f* and 140*h* are located opposed to one another across the central panel 145. Each minor panel

Figure 3A:
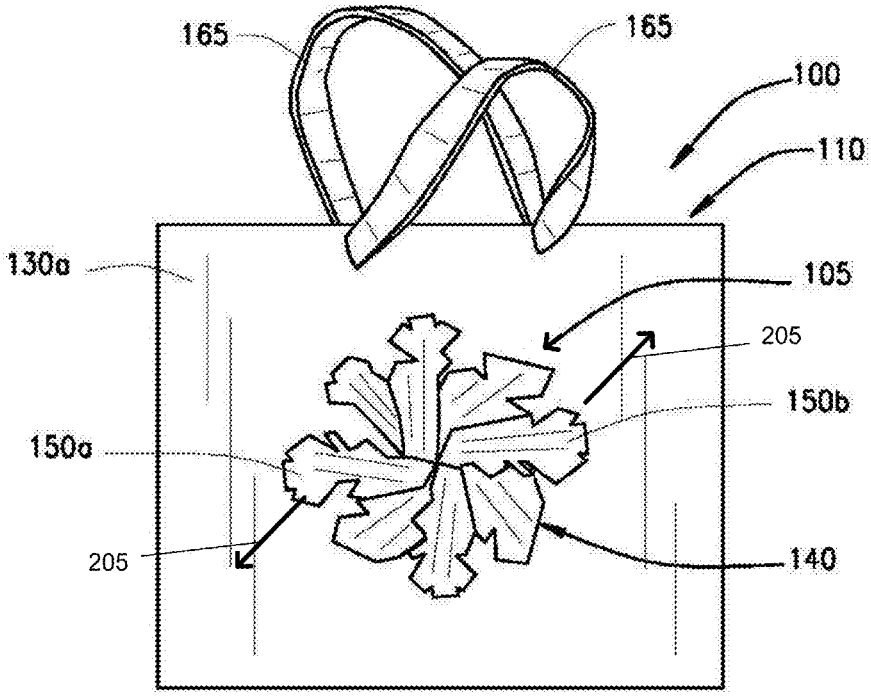
FIG. 3A is a front elevation view of the container of FIGS. 1A-B showing the presentation element in a substantially closed disposition according to one embodiment.
Figure 3B:
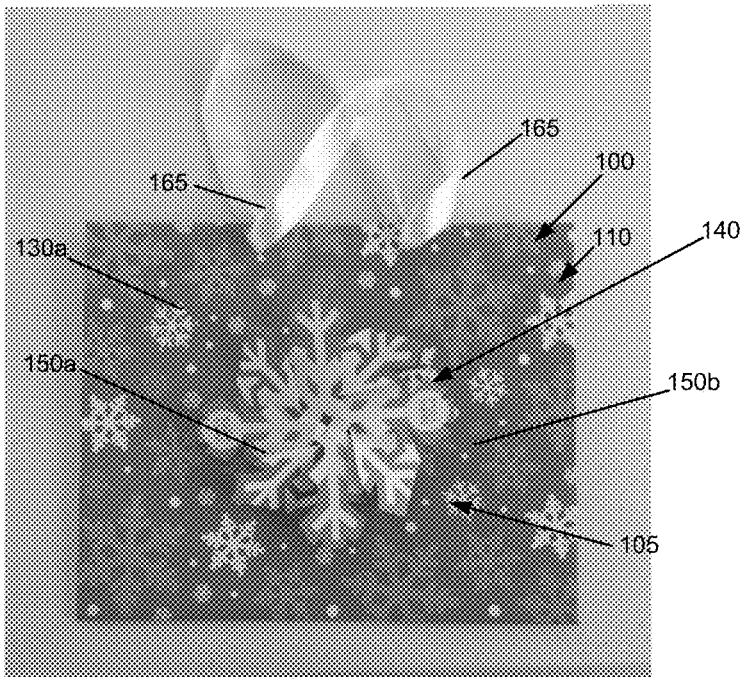
FIG. 3B is a front elevation photograph of the container of FIGS. 1A-B showing the presentation element in a substantially closed disposition according to one embodiment.
Figure 4A:
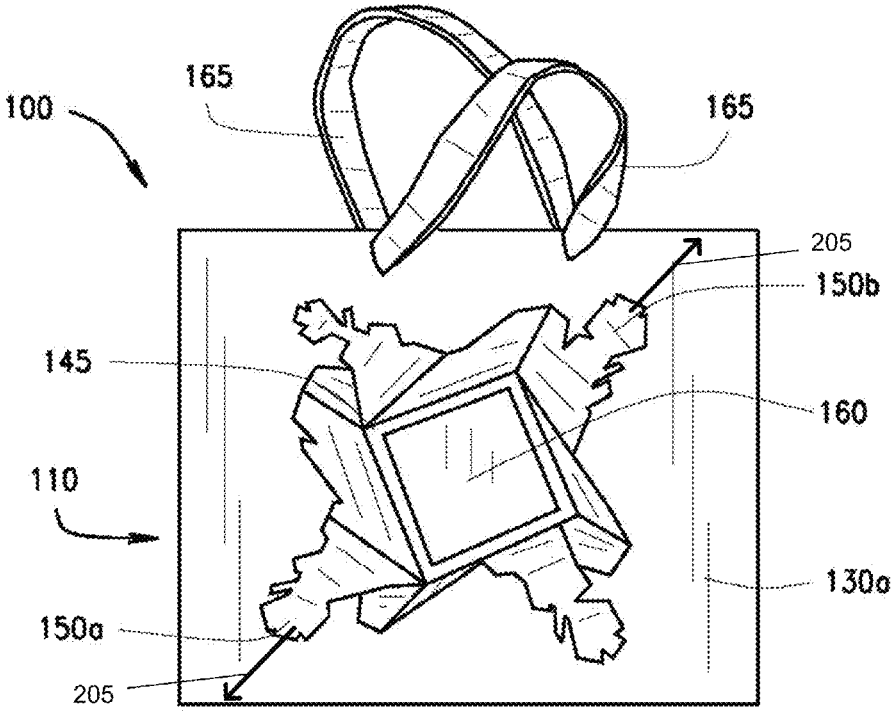
FIG. 4A is a front elevation view of the container of FIGS. 1A-B showing the presentation element in a partially open disposition according to one embodiment.
Figure 4B:
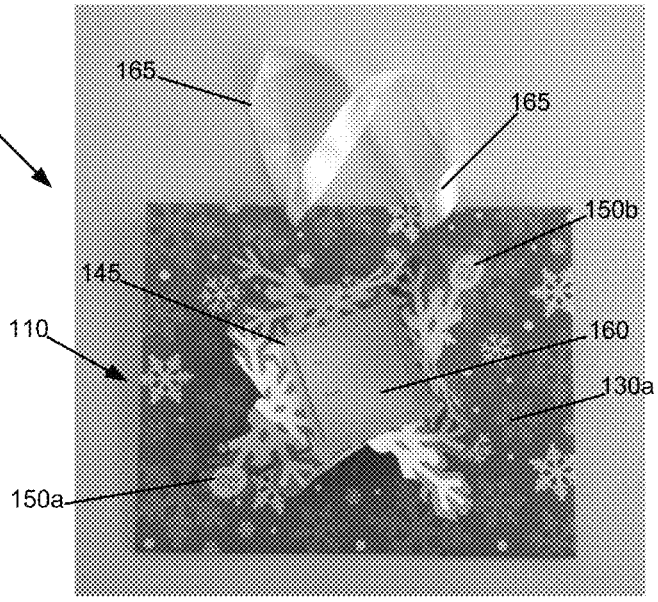
FIG. 4B is a front elevation photograph of the container of FIGS. 1A-B showing the presentation element in a partially open disposition according to one embodiment.

140*h* and 140*f* includes a respective pull tab 150*a* and 150*b* at their outer portions or margins. Pull tab 150*a* extends from the outer portion or margin of minor panel 140*h* and pull tab 150*b* extends from the outer portion or margin of minor panel 140*f*. When the articulated panels 140 are folded to close the presentation element 105, the articulated panels 140 may be at least partially unfolded to open the presentation element 105 by pulling the pull tabs 150 outwardly and in substantially opposing directions, as generally indicated by 215 in FIGS. 3A and 4A. FIGS. 3A-B show the presentation element 105 in a substantially closed disposition or configuration, while FIGS. 4A-B show the presentation element in a partially open disposition or configuration.

Figure 10:
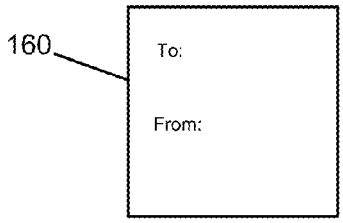
FIG. 10 is a plan view of a presentation card according to one embodiment.

In various embodiments, the central panel 145 of the presentation element 105 may include an adhesive 157 on a rear face 158 thereof to adhere the central panel 145, and thereby the presentation element 105, to a side 130 of the main body 110. In other embodiments, the presentation element 105 may be attached or affixed to the main body 110 by other suitable means. In one embodiment, the presentation element 105 may be integrated with the main body 110. Slits 155 in the central panel 145 may be provided to receive either a transaction card (such as a gift card) or a presentation card 160 bearing presentation indicia, such as prompts "TO" and "FROM" to indicate to the user to transcribe the gift giver's and gift recipient's names, as shown in FIG. 10.

Figure 11:
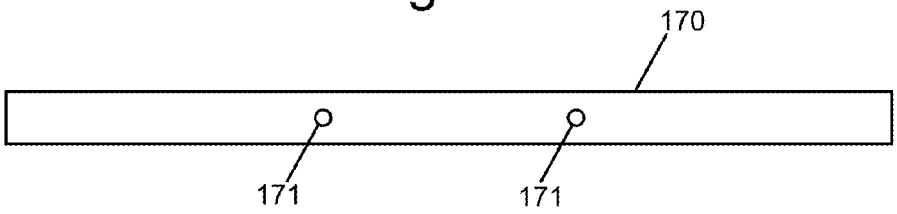
FIG. 11 is a plan view of a handle support board that may be used reinforce a side of the main body to which a handle is attached according to one embodiment.
Figure 12:
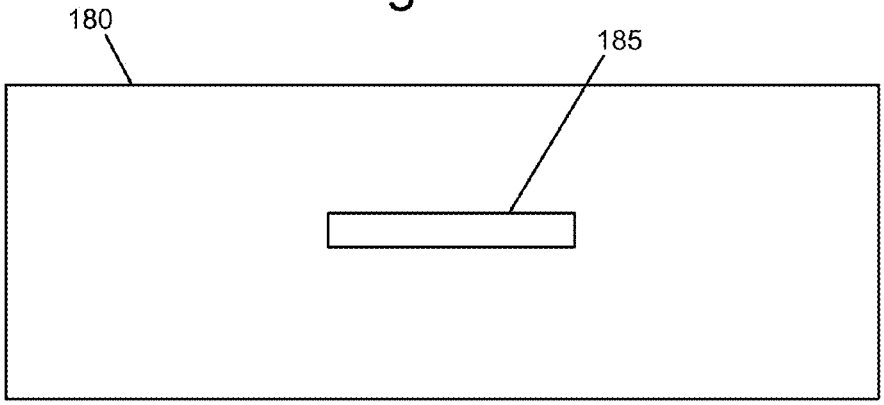
FIG. 12 is a plan view of a container bottom support board according to one embodiment.

As shown in FIGS. 3A-4B, the container 100 may be a gift bag that includes handles 165. By way of example and not limitation, the handles 165 may be attached to the first (front) side 130*a* and third (back) side 130*c*. Handles 165 may comprise fabric, ribbon, plastic, paper, or other suitable material. In one embodiment, a handle support board 170, shown in FIG. 11, may be used to reinforce sides 130*a* and 130*c* of the main body 110 to which a handle 165 is attached. Handles 165 may be threaded through apertures 111 in the sides 130*a* and 130*c* and through apertures 171 in the support board 170. FIG. 12 is a plan view of a container bottom support board 180 that may be placed within the main body 110 and against the bottom end of the main body 110. An adhesive strip 185 on a lower surface of the board 180 may be used to secure the board 180 in place.

Figure 9:
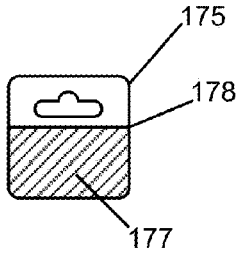
FIG. 9 is a plan view of a removable hang tag that may be attached to the main body according to one embodiment.

When the container is displayed for sale at a retail location, a removable hang tag 175, as shown in FIG. 9. may be attached via adhesive 177 to the main body 110. In one aspect, the adhesive 177 may be a removable adhesive to allow the removal of the hang tag 175. In another aspect, the hang tag 175 may be removed by tearing along a transverse perforation 178.

Figure 5:
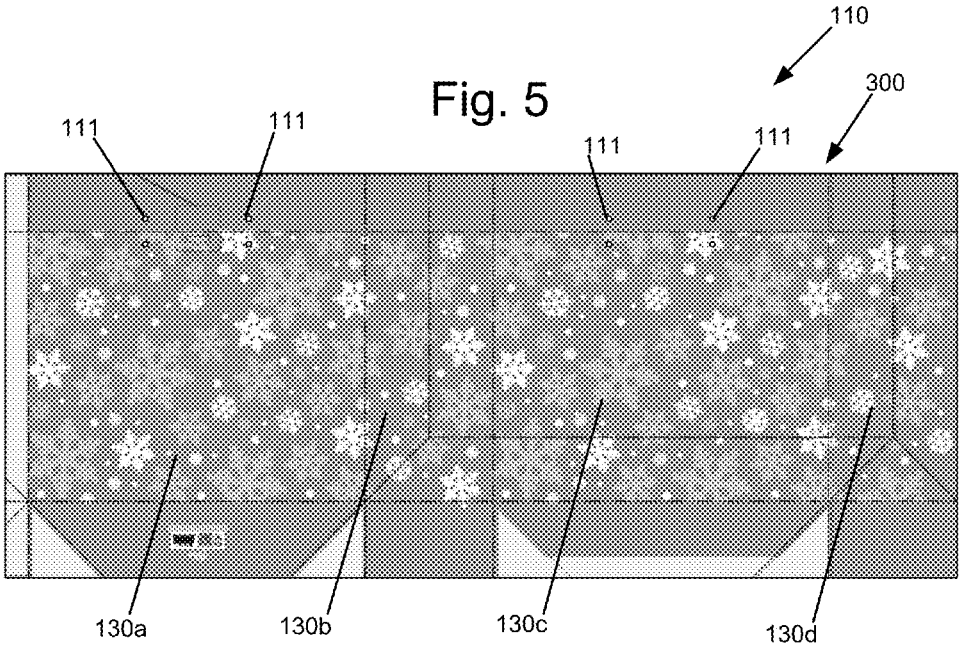
FIG. 5 is a plan view of outer surfaces of an unassembled main body of a container according to one embodiment.
Figure 6:
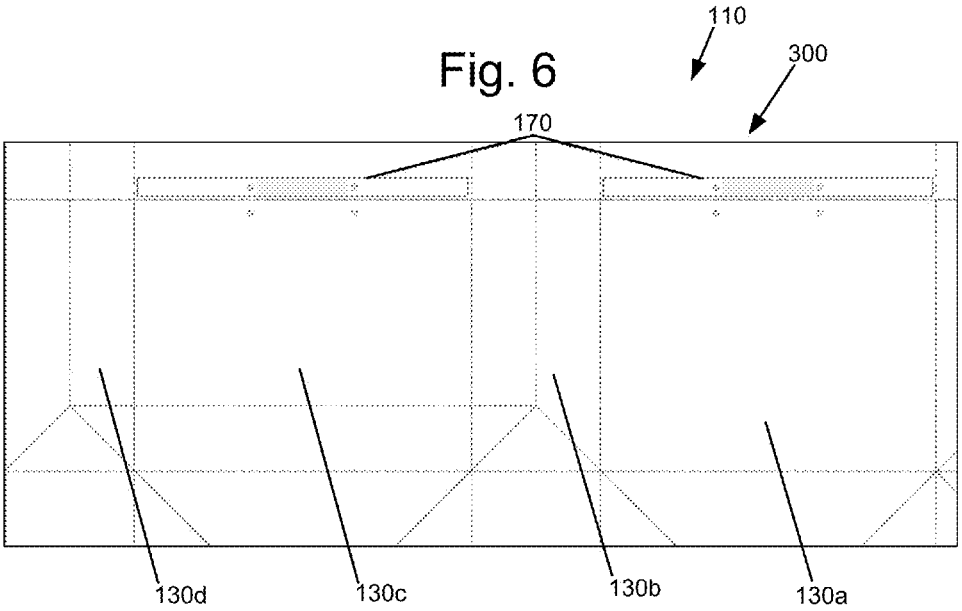
FIG. 6 is a plan view of inner surfaces of an unassembled main body of a container according to one embodiment.

In various embodiments, the main body 110 may be formed from a planer material 300. As shown in FIGS. 5 and 6, the planar material of an unassembled main body 110 may include of lines, folds, scores, and/or other markings that define the boundaries or features for the first side 130*a*, second side 130*b*, third side 130*c* and fourth side 130*d* as well as bottom panels that join to one another to close the bottom end 125. In one embodiment, the main body may be assembled by folding portions of the planar material 300 along various fold lines and using an adhesive or other attachment or fasteners (not shown) to form the main body.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular implementations. Functionality may be separated or combined in blocks differently in various embodiments of the disclosure or described with different terminology. These and other variations, modifications, additions, and improvements may fall within the scope of the disclosure as defined in the claims that follow.

Those skilled in the art will appreciate that variations from the specific embodiments disclosed above are contemplated by the disclosure. The following disclosure should not be restricted to the above embodiments, but should be measured by the following claims.

What is claimed is:

1. A container with an articulating comprising:

a main body comprising a plurality of sides and a closed bottom portion, where the plurality of sides define a chamber having an open end opposite the closed bottom portion; and a reclosable presentation element engaged to a side of the main body, the presentation element defining a receptacle having an open configuration and a closed configuration, the presentation element further comprising:

a central panel having plurality of margins;

a plurality of articulating major panels corresponding to the plurality of margins, where each of the plurality of articulating major panels is hingedly engaged to the corresponding central panel margin;

a plurality of articulating minor panels disposed between the plurality of articulating major panels, where a first margin of each of the plurality of articulating minor panels is hingedly engaged to one articulating major panel and a second margin of each of the plurality of articulating minor panels is hingedly engaged to another articulating major panel;

where each of the plurality of articulating major panels rotates about the corresponding central panel margin inwardly and towards the central panel to assume the closed configuration; and where each of the plurality of articulating major panels rotates about the corresponding central panel margin outwardly and away from the central panel to assume the open configuration.

2. The container of claim 1, where each of the plurality of articulating minor panels rotates about each corresponding first and second margins away from the central panel to assume the closed configuration.

3. The container of claim 1, where each of the plurality of articulating minor panels rotates about each corresponding first and second margins towards from the central panel to assume the open configuration.

4. The container of claim 1, where two opposing articulating minor panels include pull tabs, where actuation of the pull tabs causes the presentation element to transition from the closed configuration to the open configuration.

5. The container of claim 1, when in a closed configuration, a first side of each of the articulating major panels overlaps a first portion of an adjacent articulating minor panel of the plurality articulating minor panels and an opposing second side of the each of the articulating major panels is disposed underneath another portion of another adjacent articulating minor panel of the plurality articulating minor panels.

6. The container of claim 1, the receptacle is adapted to receive a card.

7. The container of claim 6, where the center panel comprises one or more slits to engage the card disposed within the receptacle.

8. The container of claim 6, where at least one side of the plurality of sides is pleated and the presentation element is engaged to a non-pleated side of the plurality of sides.

9. The container of claim 1, where the presentation element is engaged to an exterior surface of the main body.

* * * * *